US005220696A

United States Patent [19]

Dannenberg et al.

[11] Patent Number: 5,220,696

[45] Date of Patent: Jun. 22, 1993

[54] TUB WITH INFLATABLE SEAL DOOR

[75] Inventors: Todd D. Dannenberg; Thomas C. Jorsch, both of Sheboygan; Peter W. Swart, Oostburg; John M. Bloemer, Sheboygan; Anthony M. August, Manitowoc; Anton J. Kolar, Sheboygan, all of Wis.

[73] Assignee: Kohler Co., Kohler, Wis.

[21] Appl. No.: 896,952

[22] Filed: Jun. 11, 1992

Related U.S. Application Data

[62] Division of Ser. No. 716,864, Jun. 18, 1991, Pat. No. 5,163,187.

[51] Int. Cl.[5] ..... A47K 3/022

[52] U.S. Cl. ..... 4/556; 49/477.1

[58] Field of Search ..... 49/477; 4/555, 556, 4/427; 277/2, 34; 220/239, 234; 215/365, 366; 405/105, 106, 104, 92; 114/201 A

[56] References Cited

U.S. PATENT DOCUMENTS

| | | | |
|---|---|---|---|
| 2,469,131 | 5/1949 | Ross | 296/44 |
| 3,124,852 | 3/1964 | Holderer | 49/477 |
| 3,284,955 | 11/1966 | Schroth | 49/477 |
| 3,302,333 | 2/1967 | Ganzinotti et al. | 49/477 |
| 3,354,655 | 11/1967 | Armand | 405/104 |
| 3,397,490 | 8/1968 | Carlson | 49/482 |
| 3,423,769 | 1/1969 | Cowley | 4/173 |
| 3,500,584 | 3/1970 | Clery | 49/477 |
| 3,769,750 | 11/1973 | Mayer et al. | 49/477 |
| 3,798,401 | 3/1974 | Kochanski et al. | 200/84 |
| 3,825,278 | 7/1974 | Schiesteri et al. | 28/150 |
| 3,857,625 | 12/1974 | Crane et al. | 16/223 |
| 3,863,275 | 2/1975 | Brendgord et al. | 4/173 |
| 3,872,541 | 3/1975 | Petersou | 16/223 |
| 3,968,597 | 7/1976 | Hirtle | 49/477 |
| 3,984,942 | 10/1976 | Schroth | 49/477 |
| 4,117,559 | 10/1978 | Boyle | 4/216 |
| 4,202,060 | 5/1980 | Touze | 4/173 |
| 4,258,444 | 3/1981 | Orstullok | 4/427 |
| 4,335,075 | 6/1982 | Kackos | 49/477 |
| 4,409,694 | 10/1983 | Barrett, Sr. et al. | 4/545 |
| 4,542,545 | 9/1985 | Johnson et al. | 4/555 |
| 4,680,817 | 7/1987 | Sloan et al. | 4/663 |
| 4,706,413 | 11/1987 | James | 49/477 |
| 5,010,600 | 4/1991 | Prisco | 4/217 |

FOREIGN PATENT DOCUMENTS

| | | | |
|---|---|---|---|
| 0457093A1 | 11/1991 | European Pat. Off. . | |
| 319156 | 3/1957 | Switzerland . | |
| 1642680 | 9/1906 | United Kingdom | 49/477 |

*Primary Examiner*—Henry J. Recla
*Assistant Examiner*—Charles R. Eloshway
*Attorney, Agent, or Firm*—Quarles & Brady

[57] ABSTRACT

For a tub which provides access through a side door, an inflatable seal is employed with the fluid connection to the seal being provided through the door hinge structure. In one embodiment, sensors are provided in conjunction with the water level in the tub so as to activate the source of pressurized fluid to the seal as well as to deflate the seal at a desired time. In another embodiment, a latching mechanism is utilized so as to provide a secure but easy delatching of the door.

5 Claims, 3 Drawing Sheets

FIG. 3
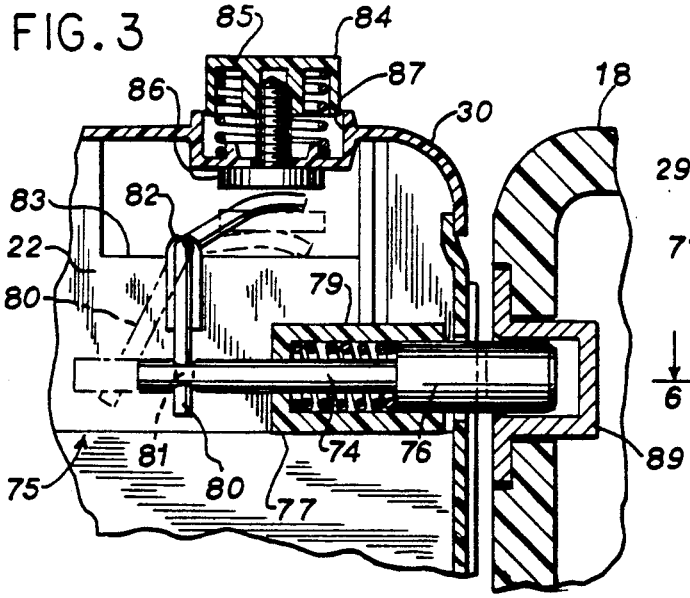
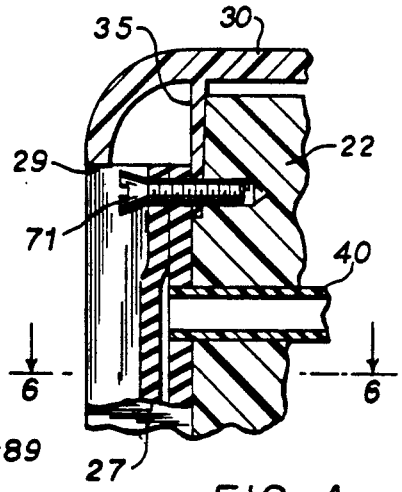
FIG. 4
FIG. 5
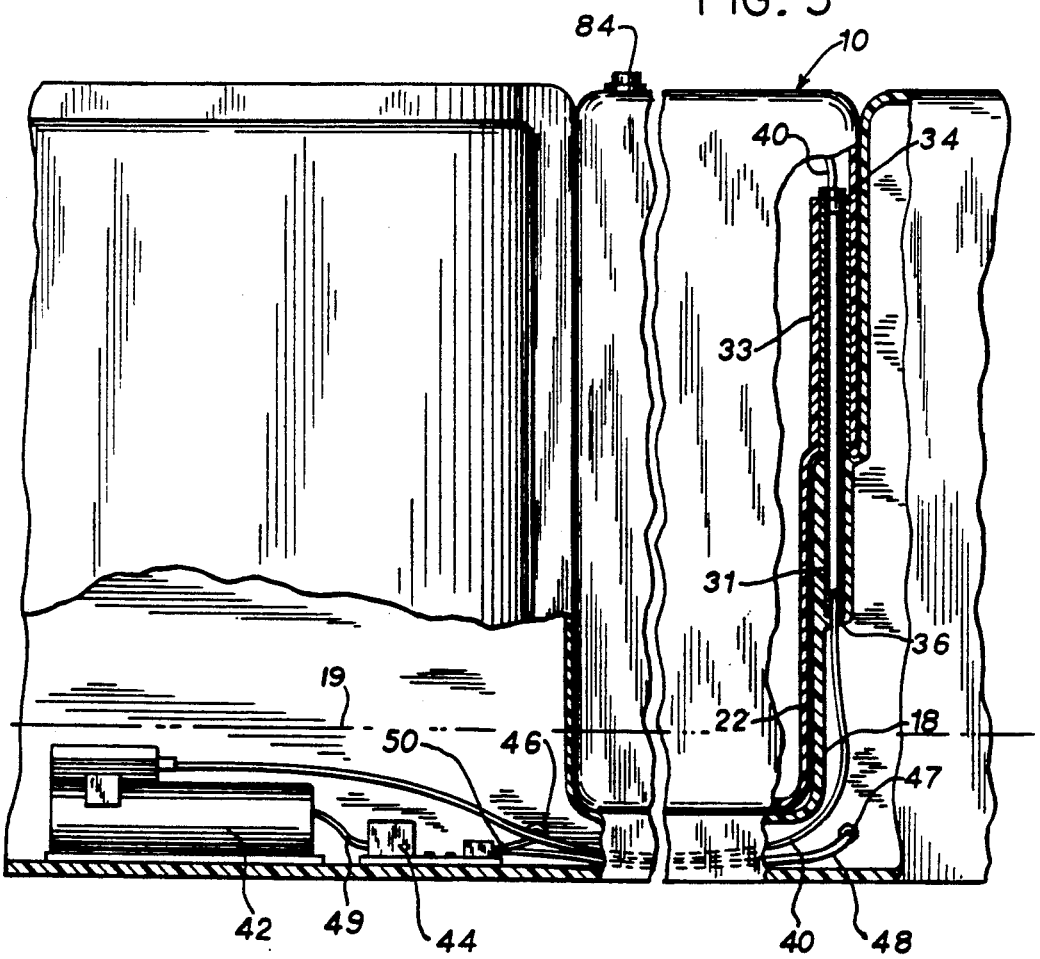

TUB WITH INFLATABLE SEAL DOOR

This is a division of application Ser. No. 07/716,864 filed June 18, 1991 now U.S. Pat. No. 5,163,187.

BACKGROUND OF THE INVENTION

1. Field Of The Invention

This invention relates to bathing structures having a side wall door to facilitate access. More particularly it relates to an inflatable seal for the door and an inflation system which prevents the seal from deflating when water is present in the tub.

2. Description Of The Prior Art

Bathtubs with side doors are known. A key problem with such tubs is sealing the door when water is in the tub. Gaskets were therefore placed around the doorway. For example, see U.S. Pat. Nos. 3,423,769 and 3,863,275. In the former patent, a seal is disposed on the doorway edge and connected by a tube in the structure forming the doorway. In the latter patent, a seal is attached to a door with a source of air in the door.

In providing air inflatable seals for such doors, it is desirable to have the inflatable seal placed on the door itself (rather than the doorway structure) so that it is not exposed to contact as a person enters or exits through the doorway of the bathing structure. Also, for aesthetic and other reasons, to minimize vandalism and for safety reasons, it is desired to conceal the supply tube which delivers air or another fluid (e.g. liquid) to such an inflatable seal. This is a problem as air compressors cannot easily be placed in the door and because the door must pivot.

Another problem in the art is controlling inflation and deflation of such a seal (especially when water is in the tub). Thus, it can be seen that an improved inflatable door system is needed.

SUMMARY OF THE INVENTION

In one form, the invention provides a tub having an inflatable seal door assembly with the tub having an enclosure defined by at least one side wall with a doorway formed in the side wall, a bottom wall and an upwardly open interior cavity. The assembly includes a door which is hingedly disposed in the doorway. A fluid inflatable seal is mounted on an edge of the door to pivot towards and away from the doorway with the door. A hinge structure is operatively associated with the doorway and the door to mount the door for the pivoting, and the hinge structure has a passage therethrough. A conduit means is disposed through the hinge passage for providing a fluid to the inflatable seal.

In a preferred form, the hinge structure includes a sleeve member telescoping over a hollow post.

In another embodiment, there is provided a system for inflating and deflating the fluid inflatable seal in the door when the door is closed. There are sensor means for sensing the level of water in the tub and means to inflate and deflate the inflatable seal operatively connected to the sensor means.

In yet another embodiment, the sensor means is arranged with respect to the inflation means so that the seal remains inflated when there is a predetermined level of water in the tub.

In still another embodiment, there is latch means operatively positioned in the door for releasable contact with the doorway. The latch means is defined by a latch bolt and activating means including a release button positioned in an upper surface of the door for releasing the latch means.

It is therefore a principal object of the invention to provide a tub which affords a concealed connection between a source of pressurized fluid in the housing of the tub and the seal in the door.

It is another object of the invention to provide a flow path for the inflating fluid through the hinge structure for the door.

It is another object of the invention to provide a system for inflating and deflating a fluid inflatable seal in such a door which affords automatic operation.

It is another object of the invention to provide a system for inflating a fluid inflatable seal in such a door which prevents undesired deflation of the seal.

It is another object of the invention to provide a latching mechanism for a door in a tub which is easily operated.

The foregoing and other objects and advantages of the invention will appear in the following detailed description. In the description, reference is made to the accompanying drawings which show, by way of illustration and not limitation, preferred embodiments of the invention.

DESCRIPTION OF THE DRAWINGS

FIG. 3 is an enlarged view in cross section taken along line 3—3 of FIG. 2 (after assembly), but showing the door in a latched position in a doorway;

FIG. 4 is an enlarged view in cross section taken along line 4—4 of FIG. 2 (after assembly), with the door cover in place;

FIG. 5 is a view in front elevation, partially fragmented, and partially in vertical section;

DETAILED DESCRIPTION OF THE PREFERRED EMBODIMENTS

Figure 1:
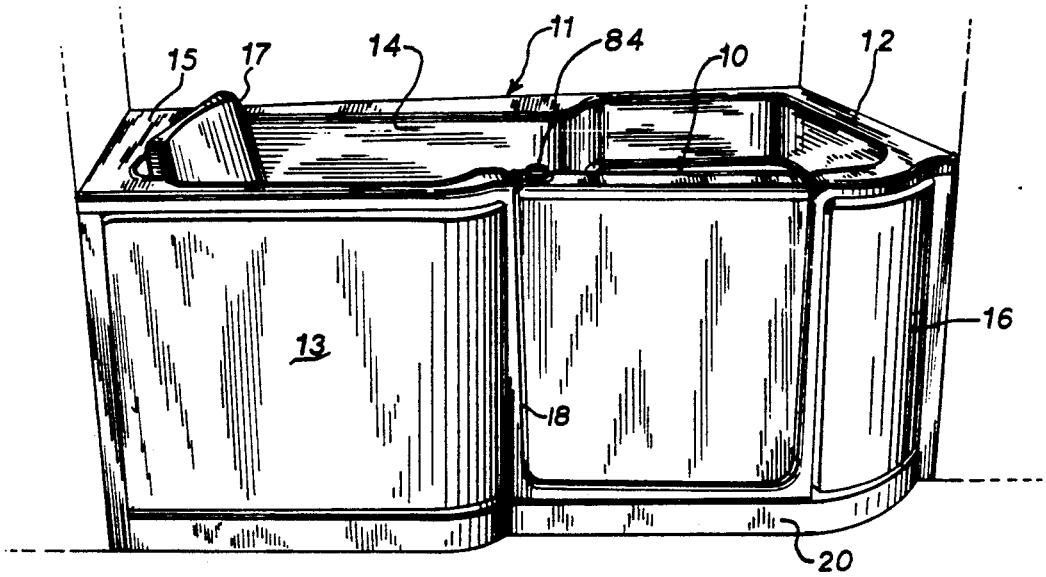
FIG. 1 is a perspective view of a bathing enclosure with an inflatable seal door in accordance with the present invention.
Figure 2:
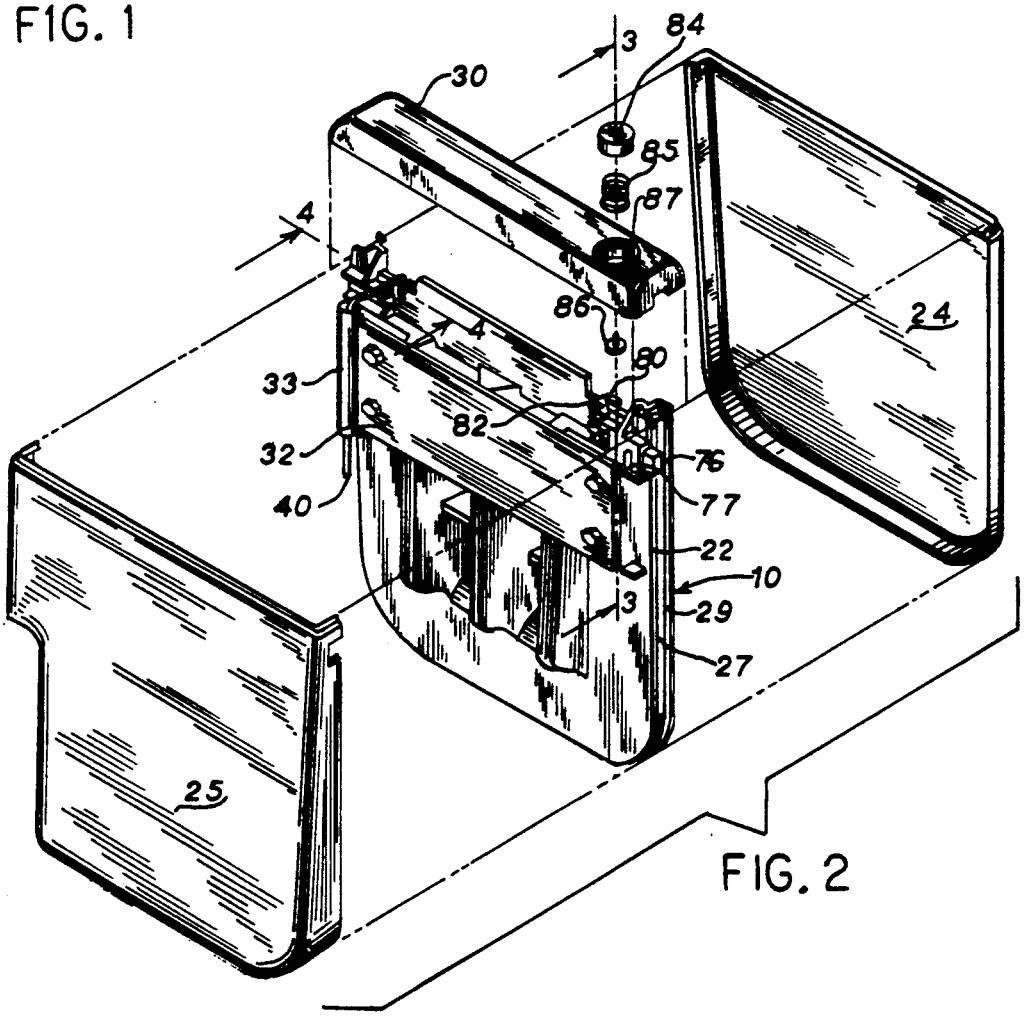
FIG. 2 is an exploded perspective view illustrating the inflatable seal door and a latching means.

Referring first to FIGS. 1 and 2, a door with inflatable seal generally 10 is shown in conjunction with a tub 11. The tub is defined by the usual side walls such as front wall panels 13 and 16, a rear wall 14, side walls 12 and 15, as well as a bottom wall 20. The tub 11 preferably includes a back rest 17. A doorway 18 is provided between the front wall panels 13 and 16 in which a door 10 is pivotally mounted. The door 10 includes a central body portion 22 over which are placed front and back panels 24 and 25, respectively, as well as a top cover 30.

Referring specifically to FIG. 5, the hinging of the door 10 is illustrated. FIG. 5 shows a support post 31 secured in a vertical tubular pocket 36 that is formed in the doorway 18. As the tub 11 is composed of fiberglass, the post 31 is bonded to the housing 36 such as with the use of resinous plastic or adhesive. Support post 31 extends upwardly and into sleeve 33 which in turn is connected to the door body 22 by the bracket 32 (see FIG. 2).

Figure 8:
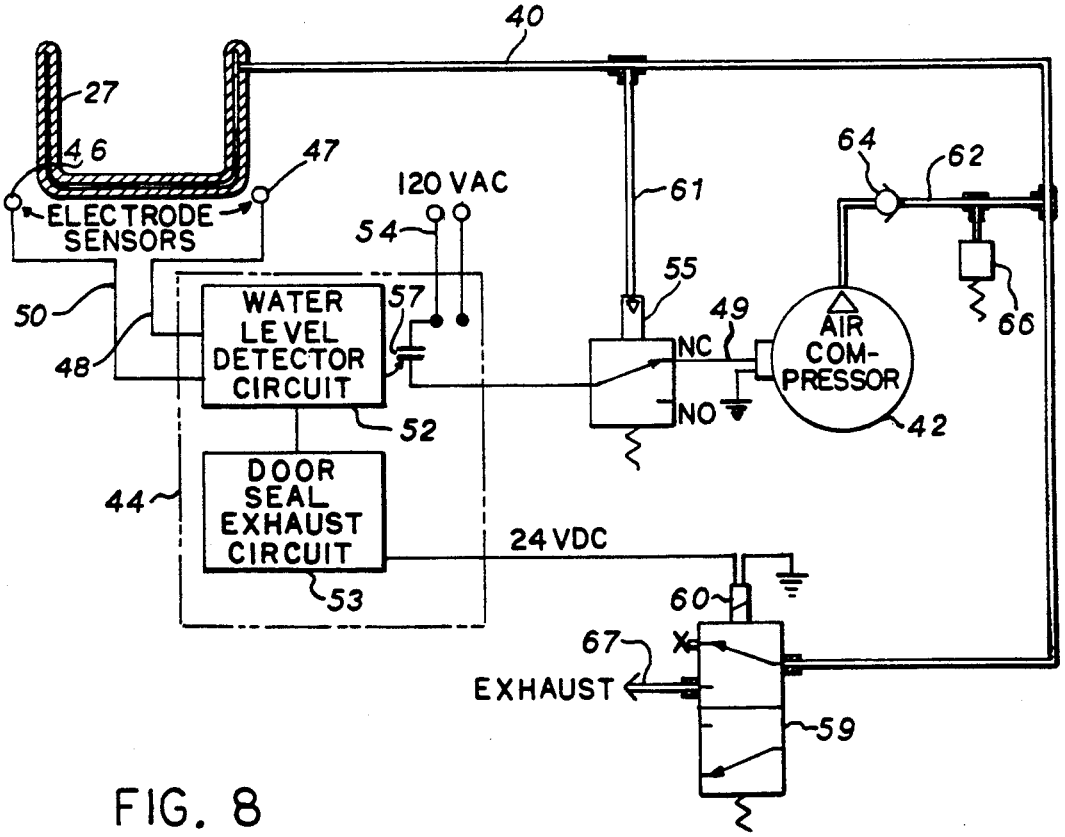

Post 31 bears against bearing 34 disposed in the end of sleeve 33. This provides the pivotal attachment of the door 10 to the doorway 18. An air feed line 40 is connected at one end to an air compressor 42 through line 62 which is shown in FIG. 8. For purposes of clarity, line 62 is not shown in FIG. 5. Air feed line 40 extends under the spill level 19 of doorway 18 and continues upwardly through the hinge structure afforded by the post 31 and the sleeve 33. This feed line 40 then extends to and is connected to the inflatable seal 27 as seen in FIGS. 2 and 4. As best seen in FIG. 4, the inflatable seal 27 is secured to door body portion 22 by the screw 71 and is housed in a channel 29 of the body portion 22. The seal 27 can be purchased from the Presray Corporation of Pawling, N.Y. as Model PR 6648.

Figure 6:
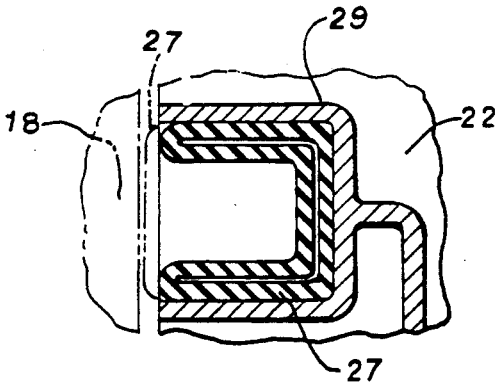
FIG. 6 is a view in horizontal section showing the inflatable seal in a non-inflated condition.
Figure 7:
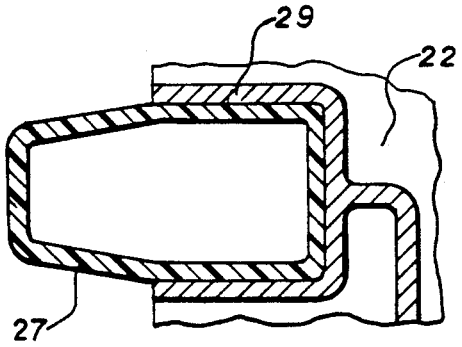
FIG. 7 is a view similar to FIG. 6 showing the inflatable seal in an inflated condition and FIG. 8 is a diagrammatic view illustrating a seal inflating and deflating control system of this invention.

Referring to FIGS. 6 and 7, it is seen that the seal in its deflated state is in a substantially U-shape as it is doubled back on itself. When expanded with air, it will extend as shown in FIG. 7. However, due to the close proximity of the doorway 18, it will not extend to its fullest extendable length, but will engage the adjacent surface of the doorway 18 as shown in FIG. 6 in dotted lines.

FIG. 8 illustrates the electrical controls for filling and deflating the inflatable seal 27. When considered in conjunction with FIG. 5, it is seen that there are two electrode sensors 46 and 47 which are placed below the spill level 19 of the doorway 18. These sensors are of the capacitive type and are connected by the lines 48 and 50 to a capacitive type circuit as shown schematically at 44. This circuit 44 controls the activation and deactivation of the air compressor 42 as well as the deflation of the seal 27. It includes a water level detector circuit 52 and a door seal exhaust circuit 53. Suitable electrical power is provided to the air compressor 42 and to the capacitive type circuit 44. Door seal exhaust circuit 53 provides a 24 volt DC power to the solenoid exhaust valve 59.

As illustrated in FIGS. 5 and 8, the sensors 46 and 47 are positioned sufficiently apart to prevent any inadvertent splashing from activating the water level detector circuit 44. This circuit is activated when the water level in the tub 11 reaches a level so that both sensors 46 and 47 are activated which completes the circuit to the compressor 42 such as through line 49. This is effected by providing a control signal in circuit 52 and a closing of the relay contacts 57 as well as completing the circuit through the pressure switch 55 so that the air compressor 42 pumps air through the line 62 to the line 40 which connects with the inflatable seal 27. The pressure switch 55 deactivates the air compressor 42 through line 61 when the pressure in the line 40 reaches approximately 15 psig. which is sufficient to maintain a seal. A check valve 64 and pressure relief valve 66 are provided in the line 62.

It will be appreciated that once the sensors 46 and 47 are activated, the water level detector circuit 52 remains activated and only the pressure switch 55 which is set at 15 psig. to maintain a seal will control the activation or deactivation of the air compressor 42. If a leak were to occur in the seal 27 or in the system, the pressure switch 55 would turn on the air compressor 42 to reinflate the seal 27. The water level detector circuit 52 remains in the previously indicated activated state until the water in the tub 11 is emptied and the water level drops below the sensors 46 and 47. When this happens, the water level circuit 52 is opened and the door bladder exhaust circuit 53 is activated. This activates the two way solenoid exhaust valve 59. This circuit 53 is a timed circuit which activates the solenoid valve 59 so as to exhaust the line 40 to atmosphere through line 67. The door seal exhaust circuit 53 remains activated for about 15 to 20 seconds or for a sufficient time to exhaust the system at which time it deactivates, and the solenoid 60 returns the exhaust valve 59 to a closed state. The system is then ready for another filling cycle as previously described.

FIG. 3 illustrates a latching mechanism generally 75 for securing the door 10 to the doorway 18. A plunger 76 is suitably positioned in guide block 77 and is biased therein by the spring 79 positioned over the reduced section 74 of the plunger 76. As seen in FIG. 2, guide block 77 is formed as a portion of the door body 22 and is in effect a compartment for housing the spring 79 and the plunger 76. A bent rod 80 has one leg thereof positioned in an aperture 81 of the plunger 76 and is secured on an upper surface 83 of the body portion 22 by the integral friction and slotted clip 82. The opposing end of the bent wire 80 is positioned under a clip 86 which is fastened to the button 84. It is activated by the downward movement of button 84 compressing the spring 85 in the recess 87. This moves the clip 86 downwardly and against the rod 80 to deflect it to the broken line showing in FIG. 3. In this position, the plunger 76 is retracted from the latch plate 89 in the doorway 18. It will be seen that the latch mechanism 75 is easily activated by merely pressing down on the button 84 at the top of the door 10. This provides easy activation by an elderly or handicapped person.

An important feature of the door 10 with the inflatable seal 27 is the fact that the air supply feed tube 40 is positioned through the hinge structure as represented by the post 31 and the sleeve 33. This allows for a concealed connection of the line to the seal 27 without bending or twisting of the air tube 40 when the door is pivoted. It also permits the source of the compressed air such as the compressor 42 to be concealed inside the structure of the tub such as wall panel 13 as is also true of the air feed tube 40. This obviates also any unintentional disconnection of the air feed tube 40.

While the through-the-hinge connection of the air feed tube 40 has been described in conjunction with a detector system for inflating and maintaining inflation of the seal member when there is water in the bathing enclosure 11, it should be understood that it can be advantageously employed without such a circuit 44. The same is true with respect to the latching mechanism 75. Further, while a particular inflatable seal 27 has been described for use with the air feed tube 40 and the connection through the hinge, it will be appreciated that any similar type of inflatable air seal tube 27 which will provide a positive seal at a relatively low pressure can also be advantageously employed. In addition, other fluids such as water, oil or gases could be employed in place of air to inflate seal 27. All such and other modifications within the spirit of the invention are meant to be in the scope of the invention.

We claim:

1. A system for inflating and deflating a fluid inflatable seal in a door which closes a doorway in a tub having an enclosure defined by at least one side wall, a bottom wall and an upwardly open interior cavity with said doorway in said side wall, said assembly comprising:

sensor means for sensing the level of water in said cavity;

means responsive to said sensor means to inflat said inflatable seal when a predetermined level of water has been sensed; and means responsive to said sensor means to deflate said inflatable seal when a predetermined level of water has been sensed.

2. The system of claim 1, wherein said sensor means is constructed and arranged with respect to said means to inflate and deflate said inflatable seal so that said seal remains inflated when there is at least a predetermined level of water in said tub.

3. The system of claim 1, further comprising pressure responsive means operatively connected to said means to inflate said inflatable seal to stop inflation of said seal at a predetermined point.

4. The system of claim 3, further including means operatively associated with said sensor means to deflate said seal when a level of water in said cavity is below a predetermined level.

5. The system of claim 4, wherein said means operatively associated with said sensor means to deflate said seal is operatively connected with a timing circuit to remain actuated for only a predetermined time.

* * * * *

UNITED STATES PATENT AND TRADEMARK OFFICE

CERTIFICATE OF CORRECTION

PATENT NO. : 5,220,696

DATED : June 22, 1993

INVENTOR(S) : Todd D. Dannenberg et al.

It is certified that error appears in the above-identified patent and that said Letters Patent is hereby corrected as shown below:

On the title page: Item [56]
Foreign Patent Documents — United Kingdom Patent "1642680" should be --1042680--.

Column 2, line 44, — after "condition" --;-- should be inserted.

Column 4,
Claim 1, line 9 — "means" should be indented.

"inflat" should be --inflate--.

Signed and Sealed this

First Day of March, 1994

*Attest:*

*Attesting Officer*

BRUCE LEHMAN

*Commissioner of Patents and Trademarks*